US009242793B1

(12) United States Patent
Ross

(10) Patent No.: US 9,242,793 B1
(45) Date of Patent: Jan. 26, 2016

(54) WINE DECANTER TO RETAIN AND PRESERVE UNCONSUMED WINE

(76) Inventor: Gary Ross, Oxnard, CA (US)

( * ) Notice: Subject to any disclaimer, the term of this patent is extended or adjusted under 35 U.S.C. 154(b) by 289 days.

(21) Appl. No.: 13/341,804

(22) Filed: Dec. 30, 2011

(51) Int. Cl.
*B65D 88/34* (2006.01)
*B65D 88/42* (2006.01)

(52) U.S. Cl.
CPC ..... *B65D 88/42* (2013.01); *B01F 2215/0072* (2013.01)

(58) Field of Classification Search
CPC ..... B01F 3/04794; B01F 3/04801; B01F 2215/0072; B65D 88/34; B65D 88/42; B65D 90/30
USPC ..... 99/277.1, 323.1, 320; 220/216, 217, 220/220, 221, 222, 719, 731, 789, 792, 801, 220/803, 804; 222/475.1, 386; 215/231
See application file for complete search history.

(56) References Cited

U.S. PATENT DOCUMENTS 203,180 A * 4/1878 Miller ..... 220/216
1,818,924 A * 8/1931 Basmadjian ..... 215/231
4,413,747 A * 11/1983 Tenold et al. ..... 220/225
4,526,797 A * 7/1985 Stone, Jr. ..... 426/520
4,907,719 A * 3/1990 Spotholz et al. ..... 222/1
4,938,377 A * 7/1990 Jarvis ..... 220/216
8,573,402 B2 * 11/2013 Cimino ..... 206/524.8
2006/0261066 A1 * 11/2006 Boozer et al. ..... 220/254.7
2007/0194057 A1 * 8/2007 Gehl ..... 222/386
2014/0103042 A1 * 4/2014 Tavenner et al. ..... 220/216

* cited by examiner

*Primary Examiner* — Reginald L Alexander
(74) *Attorney, Agent, or Firm* — Thomas I. Rozsa

(57) ABSTRACT

A wine decanter including a vessel having a bottom wall and a circumferential sidewall with a top rim including a pouring lip, a bottom wall and a circumferential sidewall surrounding an inner chamber, a sealing top fitting within the top rim of the vessel, the sealing top having at least one circumferential sealing ring, the inner chamber having a diameter which is approximately the same diameter of a standard 750 ml bottle of wine, the inner chamber having a bottom portion which retains an amount of wine. A floating sealing disc with a diameter slightly smaller than the diameter of the inner chamber of the sel floats on top of the wine in the inner chamber, thereby preventing oxygen from coming into contact with a top portion of the wine.

6 Claims, 5 Drawing Sheets

WINE DECANTER TO RETAIN AND PRESERVE UNCONSUMED WINE

BACKGROUND OF THE INVENTION

1. Field of the Invention

The present invention relates to the field of red wine and to apparatus which retains a portion of the red wine which has not been consumed at the time the original bottle for the wine was opened.

2. Description of the Prior Art

Wine has been a popular beverage for centuries. Wine is typically made in casks and subsequently poured into bottles that typically are of a size capacity to retain 750 ml of red wine. Most wine bottles are closed with a cork or a screw-on cap. The typical wine bottle capacity of 750 ml is approximately 25 ounces which provides four (4) glasses of wine. When entertaining, in most situations the entire bottle of wine is consumed at the time the bottle of wine is opened.

A bottle of wine can cost from a few dollars up to hundreds of dollars. If a bottle of wine is opened and for whatever reason some of the contents remain unconsumed, the unconsumed portion may represent a significant investment.

There is a new class of commerce in the wine industry called "wine preserve". If a bottle of red wine is opened, the oxygen in the bottle will end up destroying the flavor of the wine. Oxygen reacts with the wine and noticeably ruins the wine. This process of oxygen ruining the wine can happen in only one or two days, Wine preserve systems known in the prior art are typically comprised of a special pump to eliminate the oxygen. The other typical solution is to add nitrogen. Nitrogen will end up laying on the surface of the wine, which will prevent the oxidation of the wine. These devices are expensive and a bit inconvenient, but they are the only currently available solution to preserve wine.

There is a significant need for an apparatus to retain and preserve unconsumed wine so that the flavor is not ruined by oxidation and the wine can be consumed several days or weeks later without losing its flavor.

SUMMARY OF THE INVENTION

The present invention is a new and novel wine decanter to retain and preserve wine, especially red wine. Wine decanters are a traditional way to serve wine and they add air to a bottle just opened up that is improved by contact with the air. However, too much air will ruin wine, especially red wine. Decanters are typically made of glass and so it is possible to make a wine decanter that has a shape that is a perfect cylinder. If the decanter is formed in a cylindrical shape similar to a bottle of wine, it will be in a shape which facilitates natural wine pouring. A key to the present invention is the incorporation of a disc which has a flat lower surface and has a diameter which is slightly smaller than the interior diameter of the decanter into which the wine has been poured. The flat disc, which can be made out of any desired material, floats on the surface of the wine and prevents contact of any oxygen with the surface of the wine.

The present invention wine preserving floating disc can be puck-shaped and can be formed in a double wall of glass with a silicone band on its circumference to protect the interior surface of the glass decanter. The wine decanter can also have a double wall design. The wine decanter can also have a single wall design. Although preferably made of glass, the wine decanter can be made out of metal such as stainless steel with the floating disc made out of stainless steel.

It is therefore an object of the present invention, to provide a retaining vessel such as a decanter, to retain wine and from which wine can be poured out into a glass for consumption.

It is a further object of the present invention to provide a barrier which will stay on the top surface of the wine in the decanter to prevent the top surface of the wine from coming in contact with oxygen which would ruin the flavor of the wine.

It is an additional object of the present invention to provide a barrier to prevent oxygen from coming in contact with the wine while at the same time permitting wine to be poured from the vessel or decanter into which the wine was originally poured.

It is an additional object of the present invention to provide a barrier which has a handle to enable the barrier to be removed, if desired.

It is further object of the present invention to provide a decanter which has approximately the same diameter of a standard 750 ml bottle of wine to facilitate the wine to be poured out of the decanter for consumption while at the same time preserving unconsumed wine with the present invention floating barrier within the decanter. The floating barrier floats on the top surface of the wine and has a diameter slightly smaller than the interior diameter of the decanter so that oxygen will not come in contact with the top surface of the wine, thereby ruining its flavor. This enables wine to be poured from the decanter since the floating barrier can rotate just enough to enable wine to be poured out of the decanter.

The wine decanter can be a single walled vessel or double walled vessel. The wine decanter can also include a lip from which the wine is poured and a sealing top to prevent outside air and/or flies or bugs from coming in contact with the wine.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
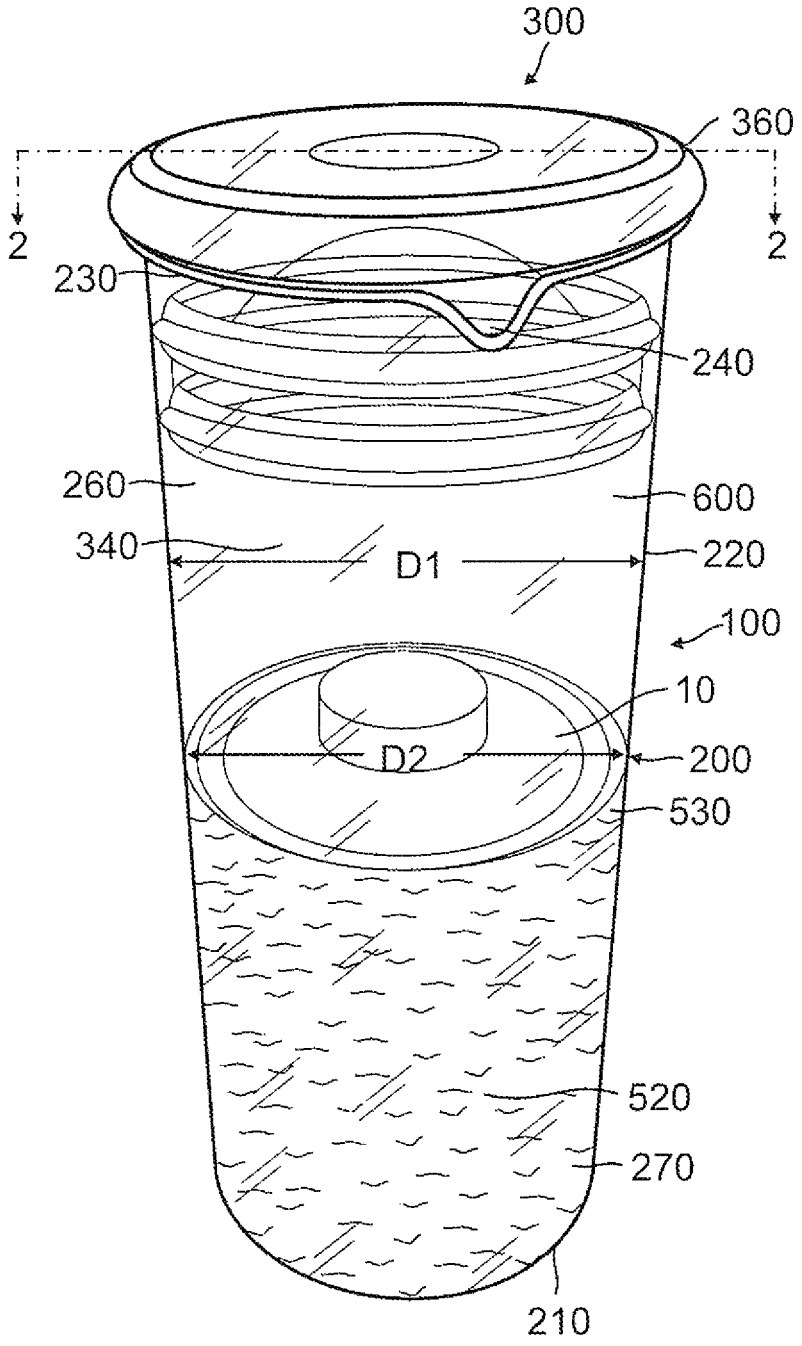
FIG. 1 is a perspective view of a preferred embodiment of the present invention wine decanter with a single wall and a floating disc with a flat bottom resting on the top surface of the wine, a floating disc resting on top of wine poured into the decanter, the wine decanter having a pouring spout and a sealing top.
Figure 2:
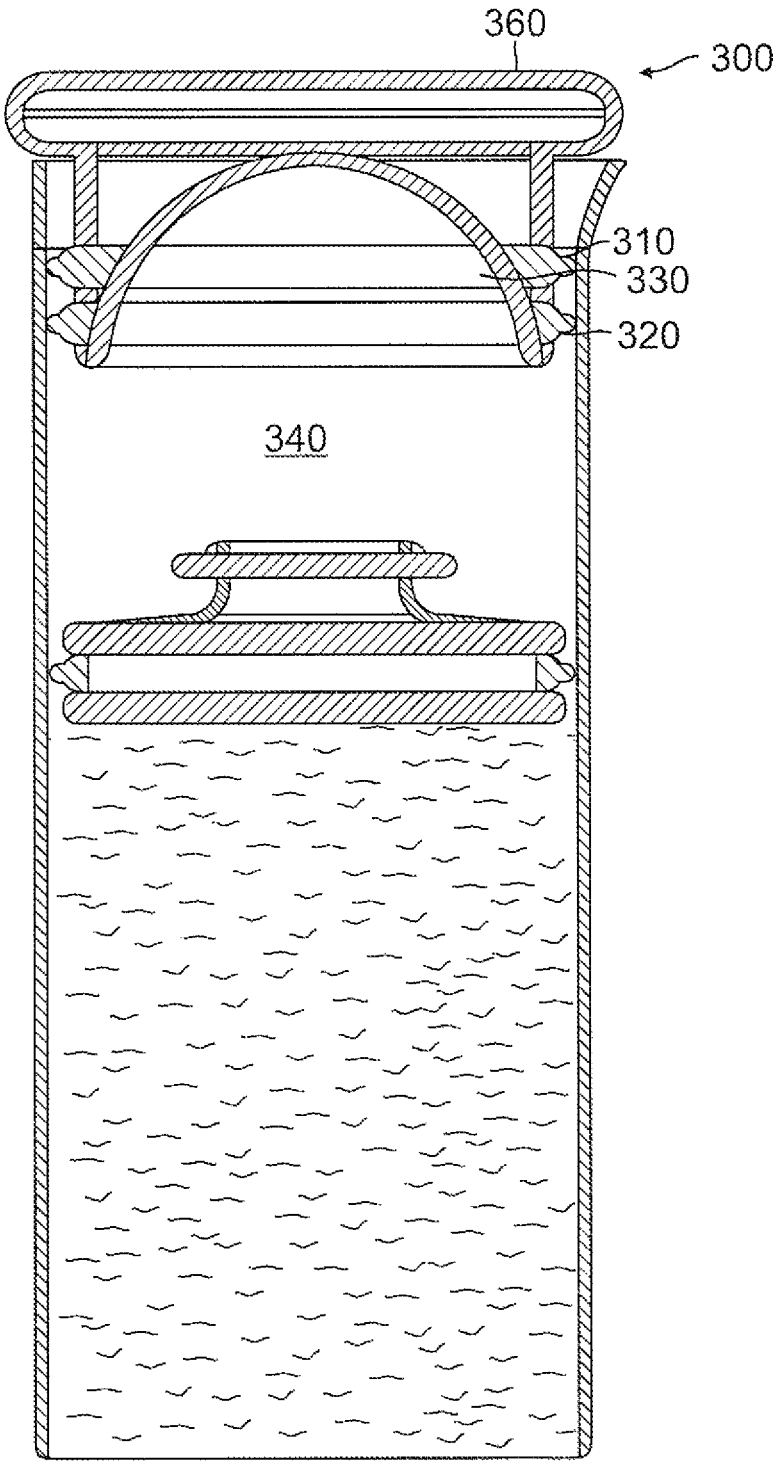
FIG. 2 is a cross-sectional view taken along line 2-2 of FIG. 1. of a preferred embodiment of the present invention wine decanter with a single wall and a floating disc with a flat bottom resting on the top surface of the wine poured into the decanter, the wine decanter having a pouring spout and a sealing top.

Referring to FIGS. 1 and 2, a wine decanter or liquid retaining vessel 100 has, in a preferred embodiment, an outer wall 200 which has a bottom wall 210 and circumferential sidewall 220 with a top rim 230 including a pouring lip 240. A sealing top 300 fits within the top rim 230 of vessel 100, the sealing top 300 having at least one, and preferably a pair, of circumferential sealing rings 310 and 320 and a dome-shaped barrier 330 to prevent outside air and flies from entering the interior 340 of the vessel 100. The sealing top 300 also has a top cap 360 which rests over the top rim 230 of the vessel 100.

Figure 5:
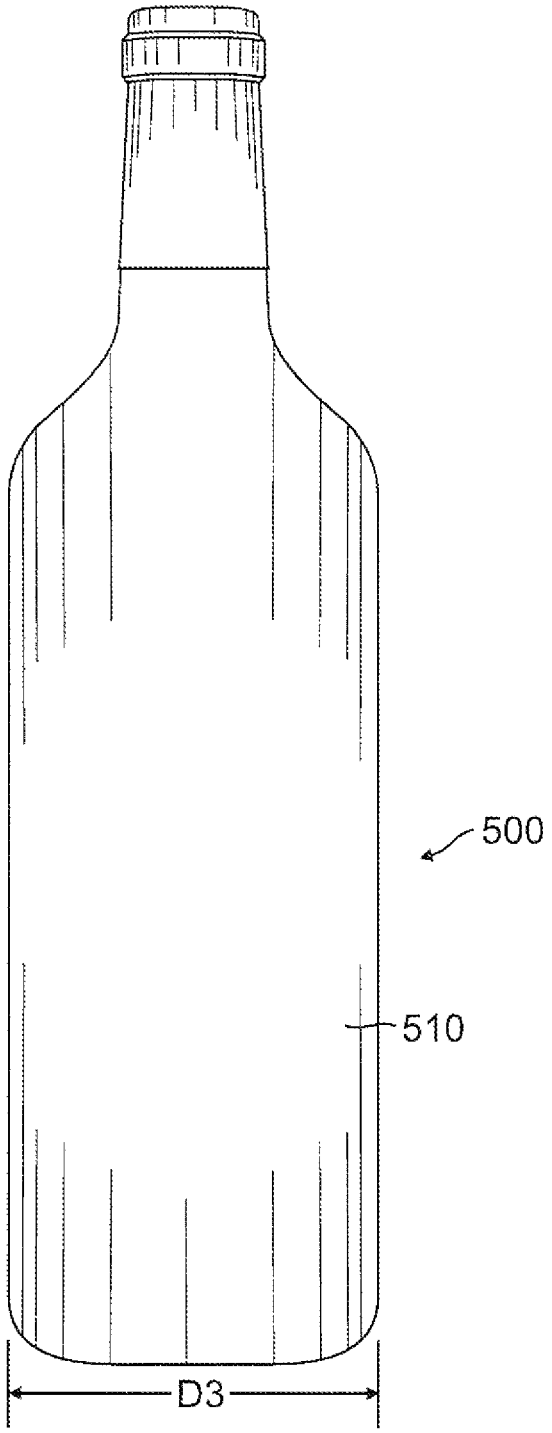
FIG. 5 is a side view of a standard 750 ml bottle of wine.

FIG. 5 illustrates a standard 750 ml bottle of wine 500 having a diameter "D3" and retaining wine 510 therein. The interior 340 of vessel 100 has an interior diameter "D1" which is approximately the same as the diameter "D3" of a standard 750 ml bottle of wine. After a bottle of wine 500 is opened, some of the wine 510 is consumed. The portion of wine 520 not consumed is poured into inner chamber 340 and is located at the bottom portion 270 of inner chamber 340.

Figure 3:
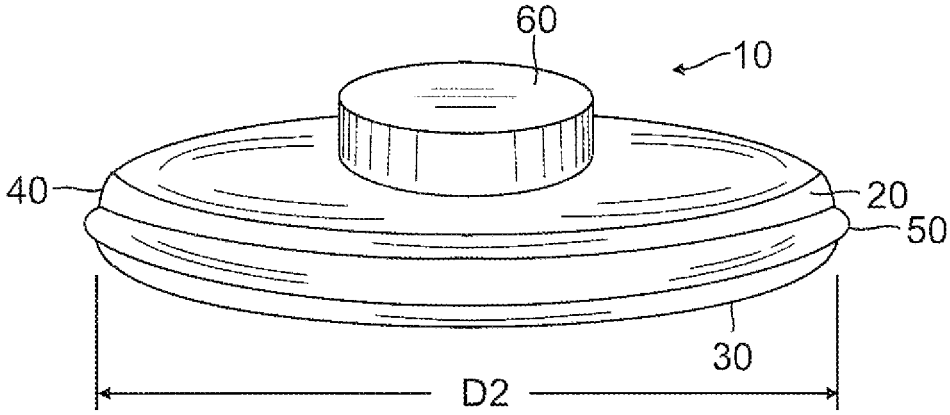
FIG. 3 is a perspective view of one embodiment of the floating barrier.
Figure 4:
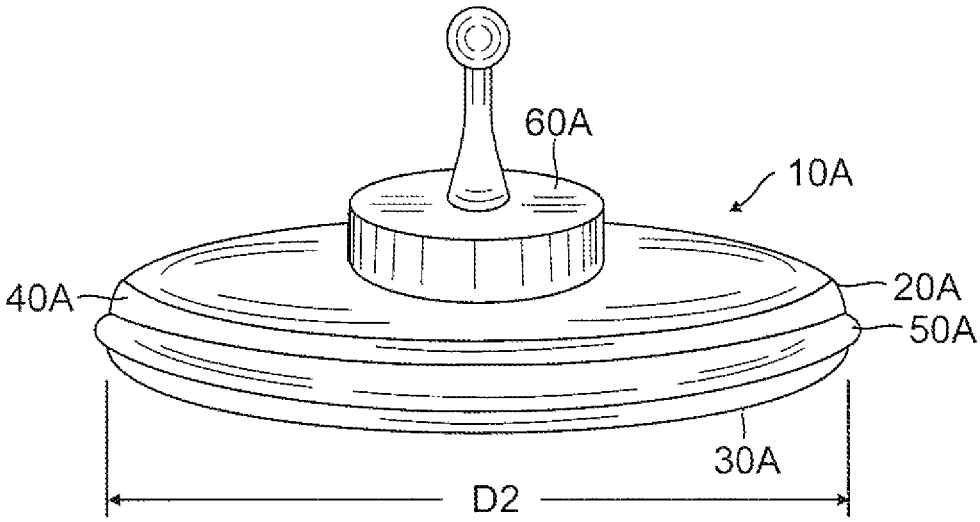
FIG. 4 is a perspective view of an alternative embodiment of the floating barrier.

The present invention is a floating top disc 10 having a diameter "D2" which is slightly smaller than the diameter "D1" of the interior chamber 340 of vessel 100. The disc 10 floats on top of the wine 520 in interior chamber 340 of vessel 100, thereby preventing oxygen 600 from the upper portion 260 of inner chamber 340 from coming into contact with the top portion 530 of the wine 520, thereby preventing the wine 520 from losing its taste. Variations of the disc are illustrated in FIGS. 3 and 4. Referring to FIG. 3, the disc 10 has a body 20 having a flat bottom surface 30 with a diameter "D2" and a sidewall 40 which preferably includes at least one circumferential sealing ring 50 to make as airtight a barrier as possible to prevent oxygen 600 from the upper portion 260 of the inner chamber 340 from coming in contact with the wine 520. The disc 10 also has a top handle 60 by which the disc 10 is inserted into the inner chamber 240 and removed from the inner chamber 240. The disc 10 illustrated in FIG. 3 is the same disc illustrated in FIGS. 1 and 2.

By having a floating disc 10 inside the inner chamber 340 after the unconsumed wine 520 is poured into the inner chamber 340 of vessel 100, the floating disc 10 provides a barrier to prevent oxygen 600 and other contaminants from coming in contact with the wine 520 so that the wine's taste and freshness will last for several days and possibly even several weeks.

Figure 6:
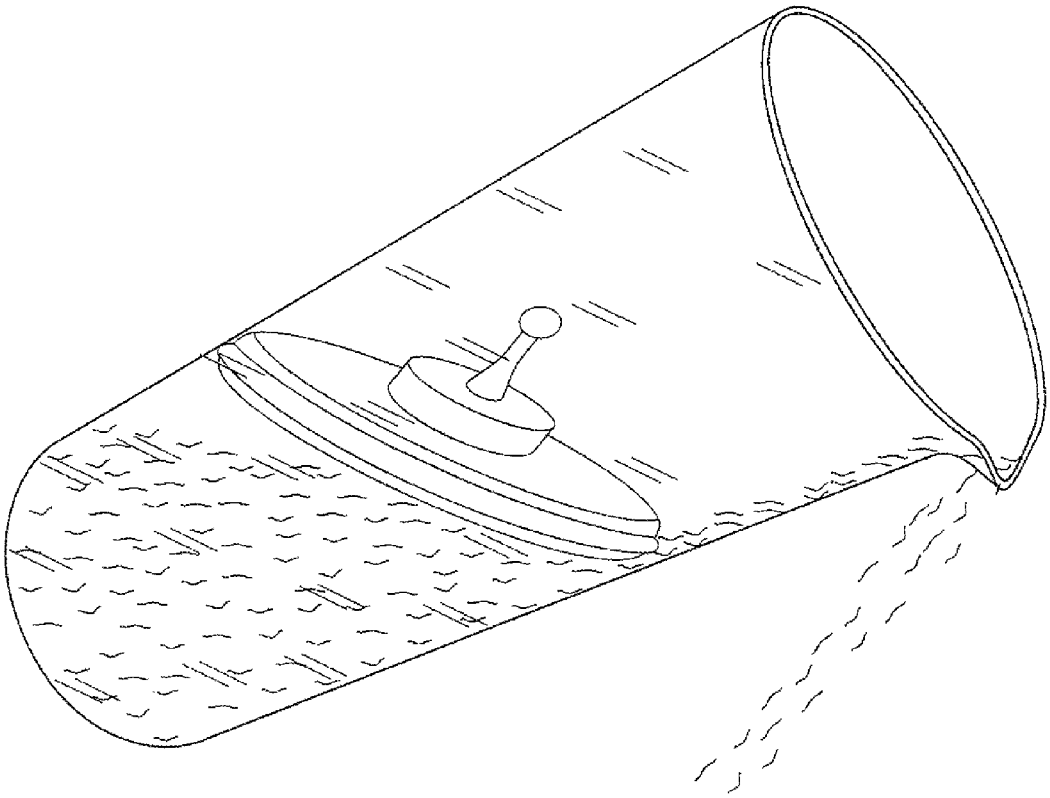
FIG. 6 is a perspective view of wine being poured from the decanter.

Referring to FIG. 6, the top sealing cap 360 is removed and then the floating disc 10 is flexible so that wine 520 can be poured out of inner chamber 340 by tiling the vessel 100 so that wine 520 can flow between the floating disc 10 which is now at an angle as illustrated in FIG. 6 to enable wine 520 to flow out of pouring lip 240 and then when the vessel 100 is righted, the remaining wine 520 flows to the bottom portion 270 of inner chamber 340 and the floating disc 10 returns to its position to reseal the remaining wine 520.

Referring to FIG. 4, a variation of the disc 10A is illustrated. The disc 10A has a body 20A having a flat bottom surface 30A with a diameter "D2" and a sidewall 40A which preferably includes at least one circumferential sealing ring 50A to make as airtight a barrier as possible to prevent oxygen 600 from the upper portion 260 of the inner chamber 340 from coming in contact with the wine 520. The disc 10A also has a decorative top handle 60A by which the disc 10A is inserted into the inner chamber 240 and removed from the inner chamber 240 of the vessel.

While a single walled vessel 100 is preferred, it is also within the spirit and scope of the present invention to have a double walled vessel with the pouring lip extending from the upper rim of the exterior vessel. The vessel 100 is preferably made out of glass but its also within the spirit and scope of the present invention for the vessels to be made out of other materials such as plastics or metal.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A wine decanter comprising:

a. a vessel having a bottom wall and a circumferential double walled glass sidewall including an outer sidewall and a spaced apart inner sidewall, the inner sidewall encircling an inner chamber with a top rim including a pouring lip, a sealing top including a top cap resting on the top rim, the sealing top further including a dome shaped barrier having a pair of spaced apart circumferential sealing rings affixed to the dome shaped barrier and resting against the inner sidewall of the double walled glass sidewall, the dome shaped barrier and the pair of spaced apart sealing rings retained within the inner chamber;

b. the inner chamber surrounded by the inner sidewall with a first diameter, the inner chamber having a bottom portion above the bottom wall, the bottom portion used in conjunction with and enabling the retention of an amount of wine; and c. a movable floatable sealing disc used in conjunction with wine retained within the vessel, the movable flotatable sealing disc floating on top of wine within the vessel, the movable flotatable sealing disc having a double wall made of glass with a spaced apart air gap between the double wall, a circumferential sealing ring retained between the double wall made of glass of the movable flotatable sealing disc, the double wall of the movable flotatable sealing disc having a second diameter which is smaller than the first diameter of the inner sidewall, and the circumferential sealing ring having a third diameter which is larger than the second diameter and smaller than the first diameter, the movable flotatable sealing disc having a flat lower surface and a top surface retaining a handle, the circumferential sealing ring enabling the movable flotatable sealing disc to form an oxygen barrier to wine below the movable flotatable sealing disc, the third diameter of the circumferential sealing ring and the second diameter of the movable flotatable sealing disc enabling the movable flotatable sealing disc to move at an angle relative to the bottom wall as the movable flotatable sealing disc floats above the portion of the wine to enable the wine to be poured out of the pouring lip when the wine decanter is tilted and the movable flotatable sealing disc is moved to an angle relative to the bottom wall with no object forming an obstruction between the top of the movable flotatable sealing disc and the pouring lip;

d. whereby, the dome shaped barrier and the pair of spaced apart sealing rings prevent outside air and flies from entering into the interior of the vessel.

2. The decanter in accordance with claim 1, further comprising: the top surface of the movable flotatable sealing disc having a flat top surface.

3. A wine decanter comprising:

a. a vessel having a bottom wall and a circumferential glass sidewall encircling an inner chamber with a top rim including a pouring lip, a sealing top including a top cap resting on the top rim, the top rim further including a dome shaped barrier having a pair of spaced apart circumferential sealing rings affixed to the dome shaped barrier and resting against the circumferential glass sidewall, the dome shaped barrier and the pair of spaced apart sealing rings retained within the inner chamber;

b. the inner chamber surrounded by the circumferential glass sidewall with a first diameter, the inner chamber having a bottom portion above the bottom wall, the bottom portion used in conjunction with and enabling the retention of an amount of wine; and c. a movable floatable sealing disc used in conjunction with wine retained within the vessel, the movable flotatable sealing disc floating on top of wine within the vessel, the movable flotatable sealing disc having a double wall made of glass with a spaced apart air gap between the double wall, a circumferential sealing ring retained between the double wall made of glass of the movable flotatable sealing disc, the double wall of the movable flotatable sealing disc having a second diameter which is smaller than the first diameter of the inner sidewall, and the circumferential sealing ring having a third diameter which is larger than the second diameter and smaller than the first diameter, the movable flotatable sealing disc having a flat lower surface and a top surface retaining a handle, the circumferential sealing ring enabling the movable flotatable sealing disc to form an oxygen barrier to wine below the movable flotatable sealing disc, the third diameter of the circumferential sealing ring and the second diameter of the movable flotatable sealing disc enabling the movable flotatable sealing disc to move at an angle relative to the bottom wall as the movable flotatable sealing disc floats above the portion of the wine to enable the wine to be poured out of the pouring lip when the wine decanter is tilted and the movable flotatable sealing disc is moved to an angle relative to the bottom wall with no object forming an obstruction between the top of the movable flotatable sealing disc and the pouring lip;

d. whereby, the dome shaped barrier and the pair of spaced apart sealing rings prevent outside air and flies from entering into the interior of the vessel.

4. The decanter in accordance with claim 3, further comprising: the movable flotatable sealing disc has a handle.

5. A wine decanter comprising:

a. a vessel having a bottom wall and a circumferential glass sidewall encircling an inner chamber with a top rim including a pouring lip, a sealing top including a top cap resting on the top rim, the top rim further including a dome shaped barrier having a pair of spaced apart circumferential sealing rings affixed to the dome shaped barrier and resting against the circumferential glass sidewall, the dome shaped barrier and the pair of spaced apart sealing rings retained within the inner chamber;

b. the inner chamber surrounded by the circumferential glass sidewall with a first diameter, the inner chamber having a bottom portion above the bottom wall, the bottom portion used in conjunction with and enabling the retention of an amount of wine; and c. a movable floatable sealing disc used in conjunction with wine retained within the vessel, the movable flotatable sealing disc floating on top of wine within the vessel, the movable flotatable sealing disc having a spaced apart double wall made of glass, a circumferential sealing ring retained around the spaced apart double wall made of glass of the movable flotatable sealing disc, the spaced apart double wall of the movable flotatable sealing disc having a second diameter which is smaller than the first diameter of the inner sidewall, and the circumferential sealing ring having a third diameter which is larger than the second diameter and smaller than the first diameter, the movable flotatable sealing disc moving at an angle relative to the bottom wall as the movable flotatable sealing disc floats above the portion of the wine to enable the wine to be poured out of the pouring lip when the wine decanter is tilted and the movable flotatable sealing disc is moved to an angle relative to the bottom wall with no object forming an obstruction between the top of the movable flotatable sealing disc and the pouring lip;

d. whereby, the dome shaped barrier and the pair of spaced apart sealing rings prevent outside air and flies from entering into the interior of the vessel.

6. The decanter in accordance with claim 5, further comprising: the movable flotatable sealing disc has a handle.

* * * * *